US006128175A

United States Patent [19]

Wright et al.

[11] Patent Number: 6,128,175

[45] **Date of Patent: *Oct. 3, 2000**

[54] APPARATUS AND METHOD FOR ELECTRONICALLY REDUCING THE IMPACT OF AN ARMATURE IN A FUEL INJECTOR

[75] Inventors: Danny Orlen Wright, Cobb's Creek; Perry Robert Czimmek, Williamsburg, both of Va.

[73] Assignee: Siemens Automotive Corporation, Auburn Hills, Mich.

[ * ] Notice: This patent is subject to a terminal disclaimer.

[21] Appl. No.: 09/276,224

[22] Filed: Mar. 25, 1999

Related U.S. Application Data

[60] Provisional application No. 60/112,607, Dec. 17, 1998.

[51] Int. Cl.[7] ..... H01H 9/00

[52] U.S. Cl. ..... 361/154; 361/160; 361/167

[58] Field of Search ..... 361/154, 187, 361/167, 160, 143, 144, 191

[56] References Cited

U.S. PATENT DOCUMENTS

| | | | |
|---|---|---|---|
| 3,671,814 | 6/1972 | Dick | 317/123 |
| 4,328,526 | 5/1982 | Dilger et al. | 361/154 |
| 4,368,501 | 1/1983 | Gingrich | 361/152 |
| 4,593,658 | 6/1986 | Moloney | 123/90 |
| 4,823,825 | 4/1989 | Buchi | 137/1 |
| 4,955,334 | 9/1990 | Kawamura | 123/90 |
| 4,957,074 | 9/1990 | Weissler | 123/90 |
| 5,009,389 | 4/1991 | Kawamura | 251/129.1 |
| 5,442,515 | 8/1995 | Wallaert | 361/187 |
| 5,650,909 | 7/1997 | Remele et al. | 361/154 |
| 5,673,165 | 9/1997 | Kuhn et al. | 361/154 |
| 5,691,680 | 11/1997 | Schrey et al. | 335/256 |
| 5,701,870 | 12/1997 | Gottshall et al. | 123/490 |
| 5,708,355 | 1/1998 | Schrey | 323/282 |
| 5,711,259 | 1/1998 | Pischinger et al. | 123/90 |
| 5,729,119 | 3/1998 | Barbour | 323/222 |
| 5,742,467 | 4/1998 | Schmitz | 361/154 |
| 5,748,433 | 5/1998 | Schrey et al. | 361/210 |
| 5,775,276 | 7/1998 | Yanai et al. | 123/90.11 |
| 5,991,143 | 11/1999 | Wright et al. | 361/187 |

*Primary Examiner*—Stephen W. Jackson

[57] ABSTRACT

A method is provided to control velocity of an armature of a fuel injector as the armature moves from a first position towards a second position. The fuel injector includes a stator core at the second position and a coil is associated with the stator core. The coil, the stator core and the armature define a magnetic circuit. The coil generates a magnetic force to cause the armature to move towards and impact the stator core. The method includes energizing the coil to permit the armature to move towards the stator core. A rate of change of magnetic flux of the magnetic circuit is determined. Closed loop feedback control of the determined rate of change of magnetic flux is used to regulate a rate of magnetic flux by controlling current to the coil so as to control a velocity of the armature upon impact with the stator core.

16 Claims, 8 Drawing Sheets

APPARATUS AND METHOD FOR ELECTRONICALLY REDUCING THE IMPACT OF AN ARMATURE IN A FUEL INJECTOR

CROSS-REFERENCE TO RELATED APPLICATION

This application expressly claims the benefit of earlier filing date and right of priority from the following co-pending patent application: U.S. Provisional Application Ser. No. 60/112,607, (Attorney Docket 98P7722US) titled "Electronically Reducing The Impact Of The Armature In A Fuel Injector" filed on Dec. 17, 1998, which is expressly incorporated in its entirety by reference.

FIELD OF THE INVENTION

This invention relates to high-speed electronic solenoids such as fuel injectors that are used in a fuel system of an internal combustion engine and, more particularly, to a system and method of electronically reducing the impact of the armature against the stator upon opening of the injector and subsequently, the impact of the injector valve against the valve seat upon closing of the injector.

BACKGROUND OF THE INVENTION

A conventional high-speed electronic solenoid of the fuel injector type includes an armature mounted for movement with respect to a stator core to open and close an injector valve. During operation of the injector, the armature impacts against the stator core upon opening of the injector and the injector valve impacts against the valve seat upon closing of the injector. Such impacts generate noise, wear, and fatigue of parts and can cause bounce which reduces the accuracy of fuel metering. Mechanical designs exists to address some of these problems, but no totally mechanical solution has been demonstrated to date, especially one which reduces injector noise.

Accordingly, there is a need to provide electronic control of an armature of an electromagnetic solenoid of the fuel injector type to produce a quiet or "soft" (near zero velocity) landing of the armature against a stator core and of the injector valve against the seat, so as to prevent excessive impact wear, to reduce the amount of noise produced by such impact, and to reduce bounce.

SUMMARY OF THE INVENTION

An object of the present invention is to fulfill the need referred to above. In accordance with the principles of the present invention, this objective is obtained by providing a method of controlling velocity of an armature of a fuel injector as the armature moves from a first position towards a second position. The fuel injector includes a stator core at the second position and a coil associated with the stator core. The coil, the stator core, and the armature define a magnetic circuit. The coil generates a magnetic force to cause the armature to move towards and impact the stator core. The method includes energizing the coil to permit the armature to move towards the stator core. A rate of change of magnetic flux of the magnetic circuit is determined. Closed loop feedback control of the determined rate of change of magnetic flux is used to regulate a rate of magnetic flux by controlling current to the coil so as to control a velocity of the armature upon impact with the stator core.

In accordance with another aspect of the invention, a fuel injector is provided and includes an armature movable between first and second positions. An injector valve is coupled to the armature for movement between closed and open positions as the armature moves between the first and second positions thereof. Spring structure biases the injector valve towards the closed position thereof. A stator core is provided at the second position and a coil is associated with the stator core. The coil, when energized, is constructed and arranged to produce a magnetic force on the armature to cause the armature to move towards the second position and impact the stator core. Circuit structure provides a certain voltage which corresponds to a level of magnetic flux of a magnetic circuit created by the stator core and the armature. Control structure controls movement of the armature. The control structure is constructed and arranged to determine the certain voltage when the armature is approaching the stator core and to use the certain voltage as a feedback variable to control the level of magnetic flux and thus control a velocity of the armature as the armature impacts the stator core.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
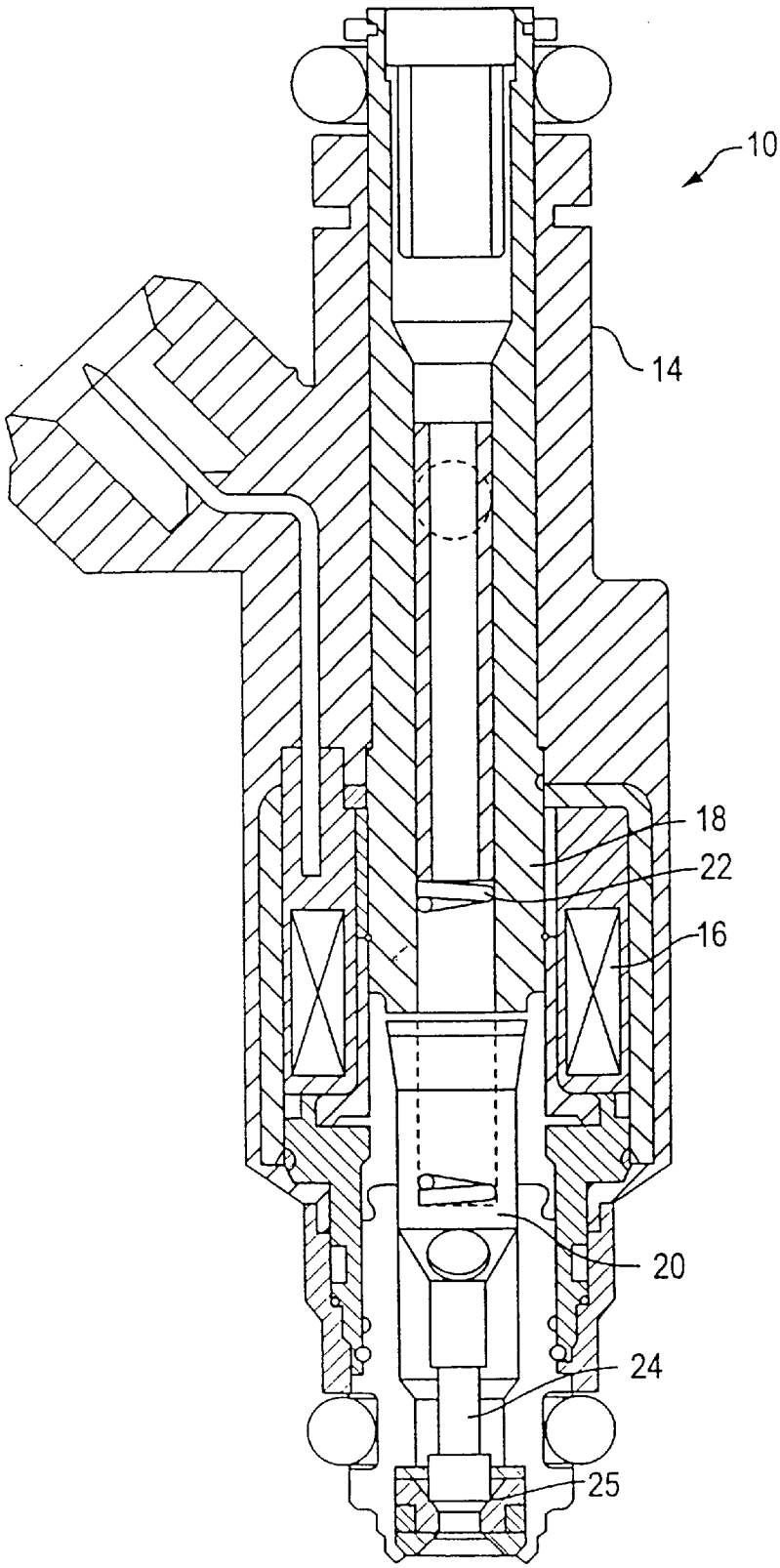
FIG. 1 is a cross-sectional view of an electronic fuel injector provided in accordance with the principles of the present invention.

Referring to FIG. 1, a fuel injector is shown, generally indicated at 10, provided in accordance with the principles of the present invention. The fuel injector 10 includes a housing 14 and a magnetic circuit disposed in the housing 14. The magnetic circuit comprises a coil 16, a stator core 18 and an armature 20. In the illustrated embodiment, the coil 16 has a resistance of 1.8 ohms designed to function with an injector driver providing 4 amps "peak" current to initially open the injector and a 1 amp sustaining or "hold" current. The number of turns of the wires comprising the coil and the gauge of the wires may be any desired number or gauge to provide the desired injector performance.

When current is supplied to the coil 16, a valve spring 22 is overpowered and an armature 20 moves from a second position to a first position causing an injector valve 24 to move from a closed position to an opened position. The current level is then reduced to a value which is just enough to hold the armature 20 in contact with the stator core 18 until the end of the desired cycle for the injector 10 at which time current is reduced to zero. When the power to the coil 16 is cut-off, the spring 22 returns the injector valve 24 to the closed position, against valve seat 25, preventing the flow of fuel to the intake manifold (not shown) of the vehicle. Thus, when the injector valve 24 is in the closed position, the armature 20 is in the first position thereof. It can be appreciated that since the armature 20 is operatively associated with the injector valve 24, the spring 22 may act directly on either the armature 20 or the injector valve 24 to bias the injector valve 24 to its closed position.

Figure 2:
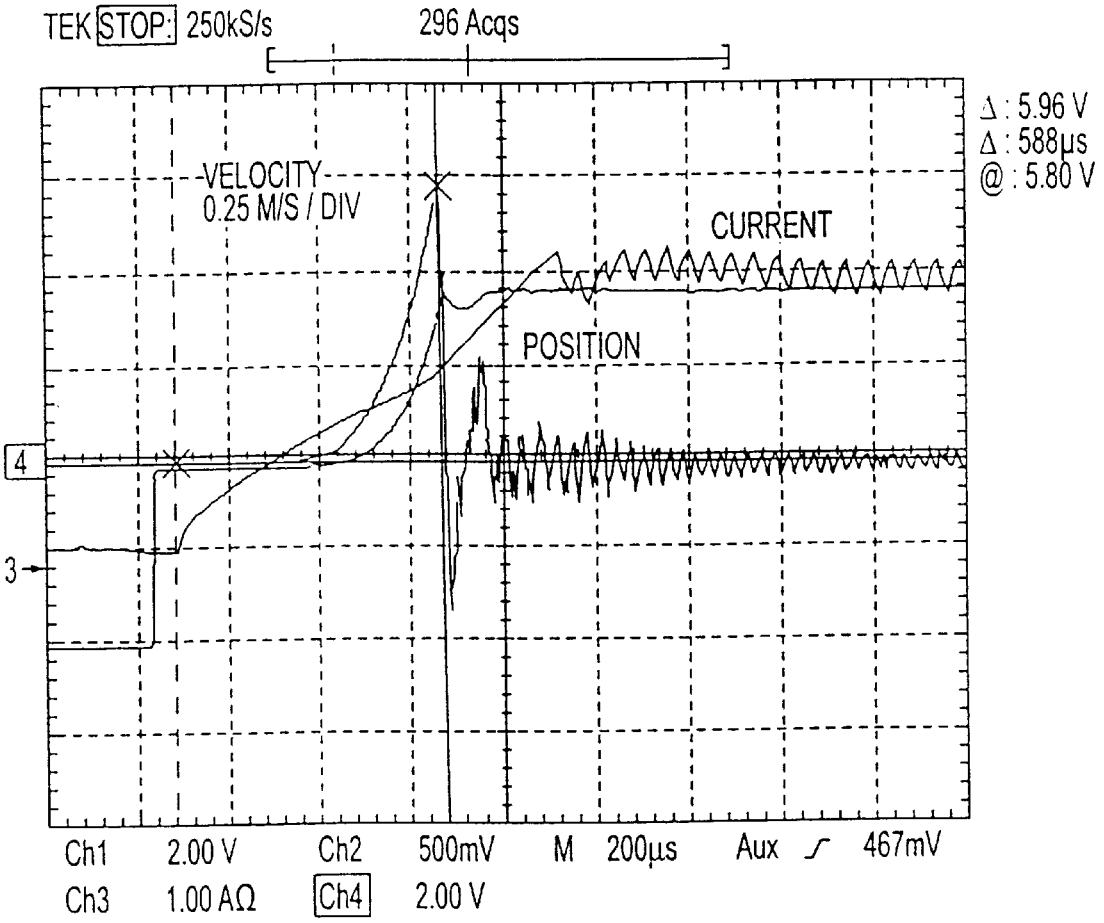
FIG. 2 (PRIOR ART)
FIG. 2 is a graph of armature position, velocity, and coil current during an opening condition of a conventional solenoid fuel injector.
Figure 3:
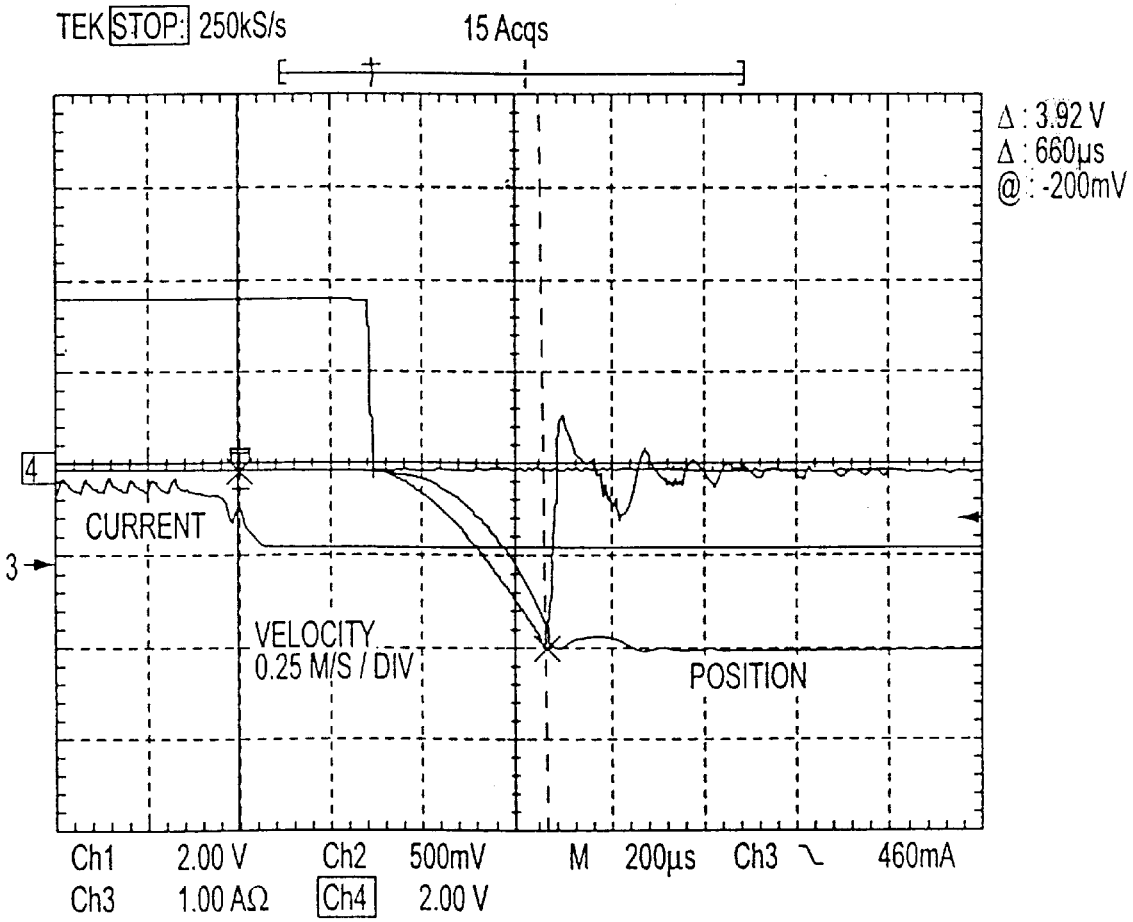
FIG. 3 (PRIOR ART)
FIG. 3 is a graph of armature position, velocity, and coil current during a closing condition of a conventional solenoid fuel injector.

A typical open-close cycle of a conventionally operated fuel injector is shown in FIG. 2 (open) and FIG. 3 (closed). In FIGS. 2 and 3, a doppler laser interferometer was employed to record the armature position and velocity of the injector. The scaling for the laser was set at 80 microns per volt (position) and 0.125 meters per second (velocity). The injector was a conventional gasoline calibration variety having a lift (distance of armature travel) setting of approximately 75 microns and a spring preload of approximately 4.5 newtons. The injector was operated "dry" to illustrate worst case characteristics of damping and pulse to pulse instability.

As is evident from FIGS. 1 and 2, respectively, the velocity at impact upon opening of the conventionally operated injector was 0.75 m/s and upon closing thereof was 0.6 m/s. Each impact was accompanied by an undesirable bounce and the velocity "rings" much like the output that would be observed from a traditional accelerometer trace (which is indeed the time derivative of velocity). The injector was audibly noisy and the detrimental effect of the high impact velocity on wear is a well-known durability issue. Flow stability pulse to pulse was limited by the stochastic nature of the bounce, primarily at closing of the injector.

U.S. patent application Ser. No. 09/025,986, entitled "Electronically Controlling the Landing of an Armature in an Electromagnetic Actuator", the contents of which is hereby incorporated into the present specification by reference, discloses using a flux sensor to sense a rate of change of magnetic flux in an electromagnetic actuator. The rate of change of flux sensed is used as a feedback variable to control a landing velocity of an armature of the actuator. U.S. patent application Ser. No. 09/122,042 entitled "A Method For Controlling Velocity Of An Armature Of An Electromagnetic Actuator", the contents of which is hereby incorporated into the present specification by reference, discloses feedback control based on a rate of change of magnetic flux without the need for a flux sensor.

The invention modifies and extends the closed loop flux control as taught by the above-mentioned patent applications to high power electromechanical solenoids of the high-speed, electronic fuel injector type.

Figure 4:
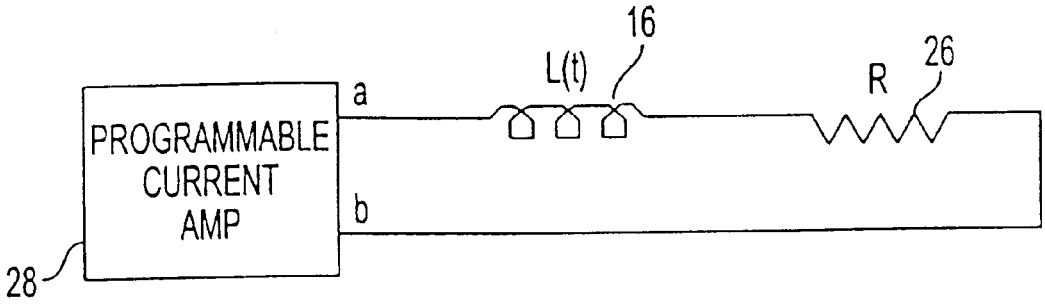
FIG. 4 is a schematic representation of a solenoid coil of the fuel injector of FIG. 1, shown connected electrically to a programmable current regulator.

As shown in FIG. 4, the coil 16 of the injector 10 of the invention has been represented as a pure inductance in series with its internal resistance 26 and the programmable current amplifier 28 is a "black box equivalent". The resistance R is essentially constant during this analysis but the inductance L(t) is seen to be time varying as a function of (primarily) the position of the armature 20 and (secondarily) the magnetic hysteresis properties with respect to magnetomotive force induced in the ferrous material of the armature 20 and associated stator core 18.

Applying Kirchoff's Voltage Law around this simple series circuit shows that the terminal voltage from (a) to (b) of the current regulator must at all times equal the sum of the IR drop on the internal resistance R and the counter electromotive force (EMF) of the coil 16. This is expressed mathematically in the following equation:

$$V(t)_{a-b} = N\frac{d(phi)}{dt} + I(t)R \qquad \text{(Equation 1)}$$

Furthermore, by Faraday's Law, the EMF of a coil having N number of turns equals the product of the number of turns times the rate of change of flux in the coil 16. In applications such as a solenoid coil for an electromechanical injector, the coil EMF is quite large during activation of the armature while the IR drop term in Equation 1 is small enough to be negligible for the purpose of sensing the rate of change of flux. Therefore, the terminal voltage on the coil 16 is nearly in exact proportion to the time rate of change of the flux in the injector 10 during operation. Thus, in view of U.S. patent application Ser. No. 09/122,042, this terminal voltage can be utilized as a feedback variable to control the impact of the armature 20 against the stator core 18 upon opening of the injector 10 and impact of the injector valve 24 at the valve seat 25 upon closing of the injector without the need for any external flux sensor.

Figure 5:
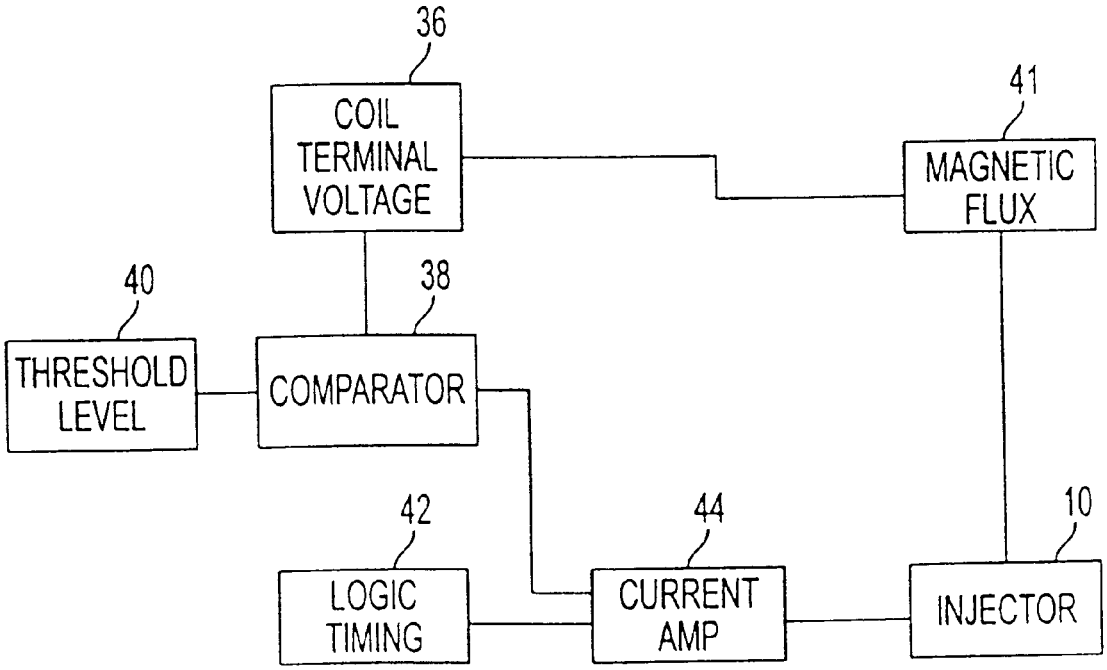
FIG. 5 is a block diagram of a control circuit of the fuel injector of FIG. 1.

With reference to FIG. 5, block diagram of an operating circuit according to the present invention is shown to achieve nearly zero velocity of the armature 20 upon landing of the armature 20 at the stator core 18. The circuit is based on controlling the armature velocity near landing by regulating a rate of change of magnetic flux in the armature/stator core magnetic circuit by measuring the terminal voltage of the coil 16. In the circuit of the FIG. 5, a terminal voltage 36 of a coil 16 is applied to a comparator 38. A threshold level 40 is also applied to the comparator 38. The output of the comparator 38 is "logically added" with a logic timing component 42 and is supplied to a programmable current amplifier 44 to drive the injector 10.

The measured coil terminal voltage 36 is compared to the threshold level 40 and the threshold level 40 is used to control current supplied to the coil 16 of the injector 10 and thus control the rate of change of magnetic flux 41 in the magnetic circuit. This is a closed loop control of magnetic flux.

Figure 6:
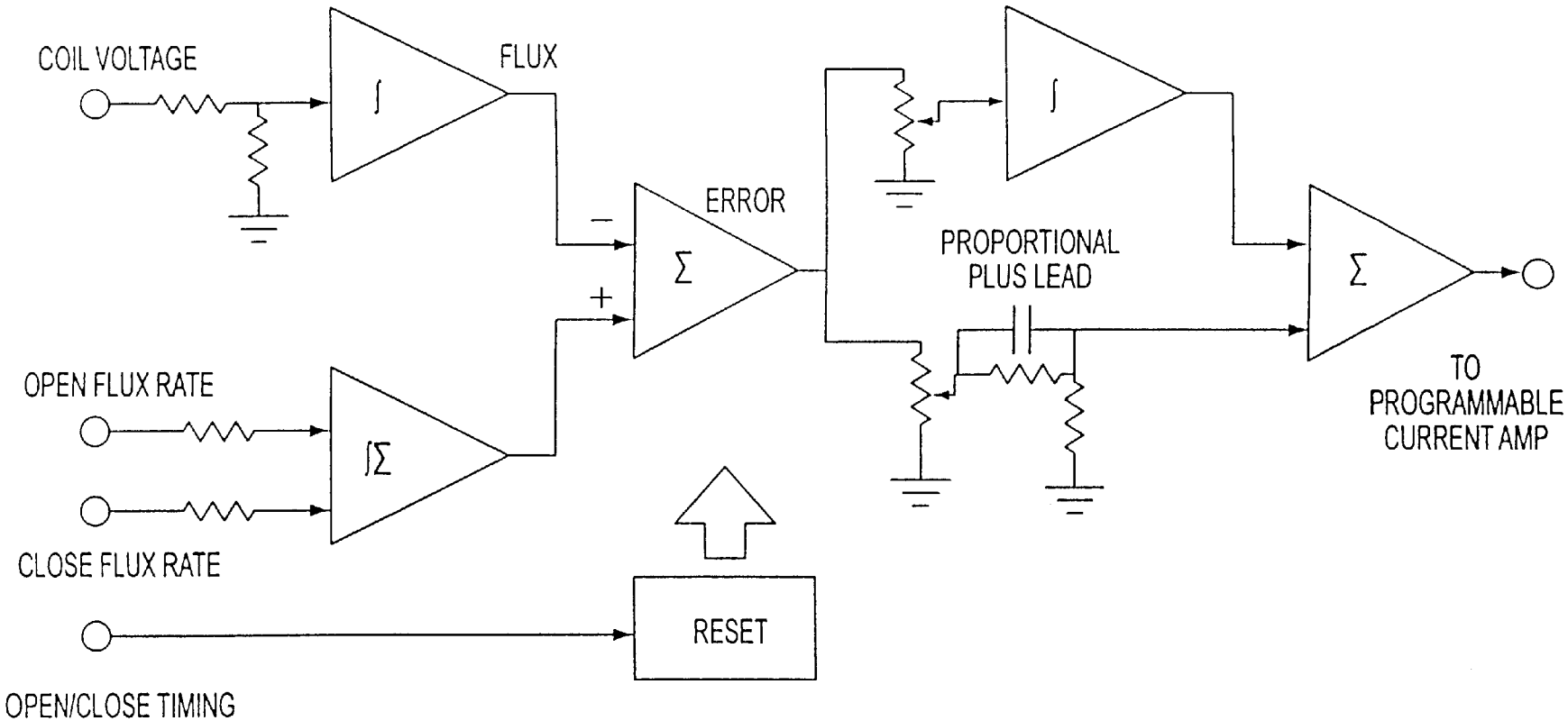
FIG. 6 is a block diagram of a flux mirror and flux rate circuit provided in accordance with the invention.
Figure 7:
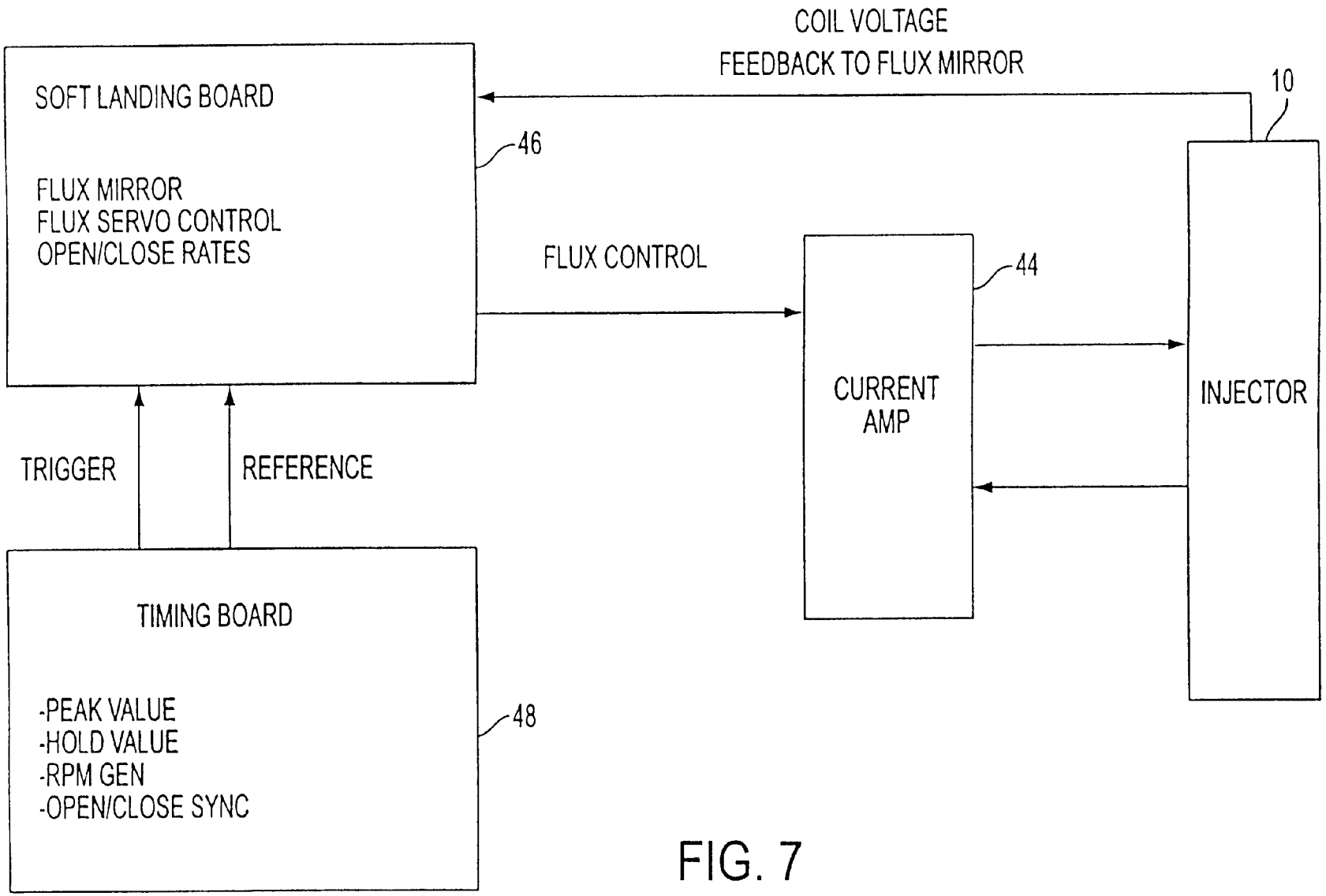
FIG. 7 is a block diagram of a control circuit of the invention including the flux mirror and flux rate circuit of FIG. 6.

Although measuring the coil terminal voltage directly is effective for controlling the landing of the armature 20 of an injector 10, it is preferable to not physically measure the common mode voltage typically present at each terminal of the coil 16. Thus, a parametrically determined mirror image of the coil terminal voltage and hence a mirror image of the rate of change of flux in the injector's magnetic circuit may be provided by the circuit of the injector 10 such that there is no need to physically touch the coil terminals to measure the coil terminal voltage. A block diagram of a flux mirror and flux rate circuit of the invention is shown in FIG. 6 and a circuit structure employing the flux mirror and flux rate circuit is shown in FIG. 7. In the circuit of FIG. 7, the flux mirror and open and close flux rate circuit are part of a soft landing board 46 and open and close timing is performed by a timing board 48. The current programming for the current regulator 44 is performed by the soft landing board 46 in order to command and regulate the desired rates of change of magnetic flux required to control the magnetic force on the armature of the injector 10. Closed loop flux regulation is accomplished by feedback of the injector coil voltage to the flux mirror circuit on the soft landing board 46.

Figure 8:
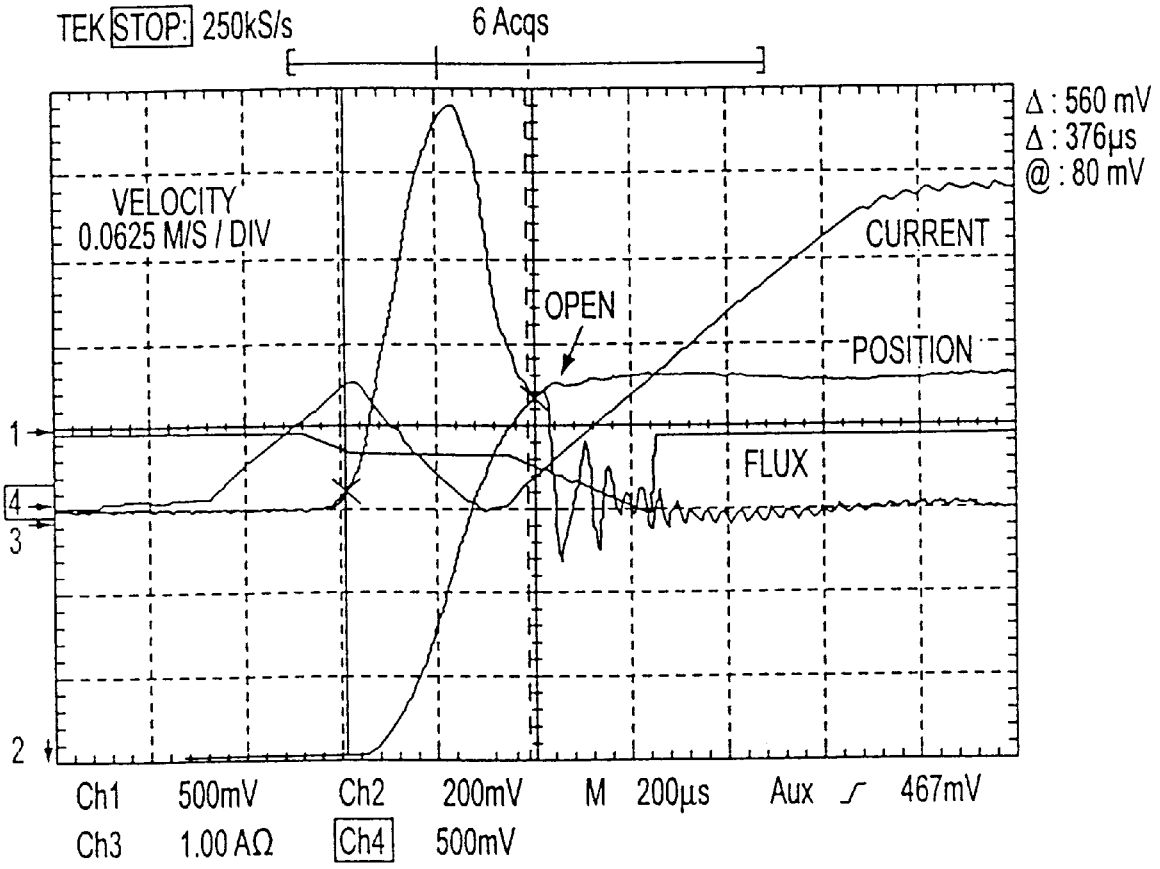
FIG. 8 is a graph of armature position, velocity, and coil current during an opening condition of the fuel injector of FIG. 1.
Figure 9:
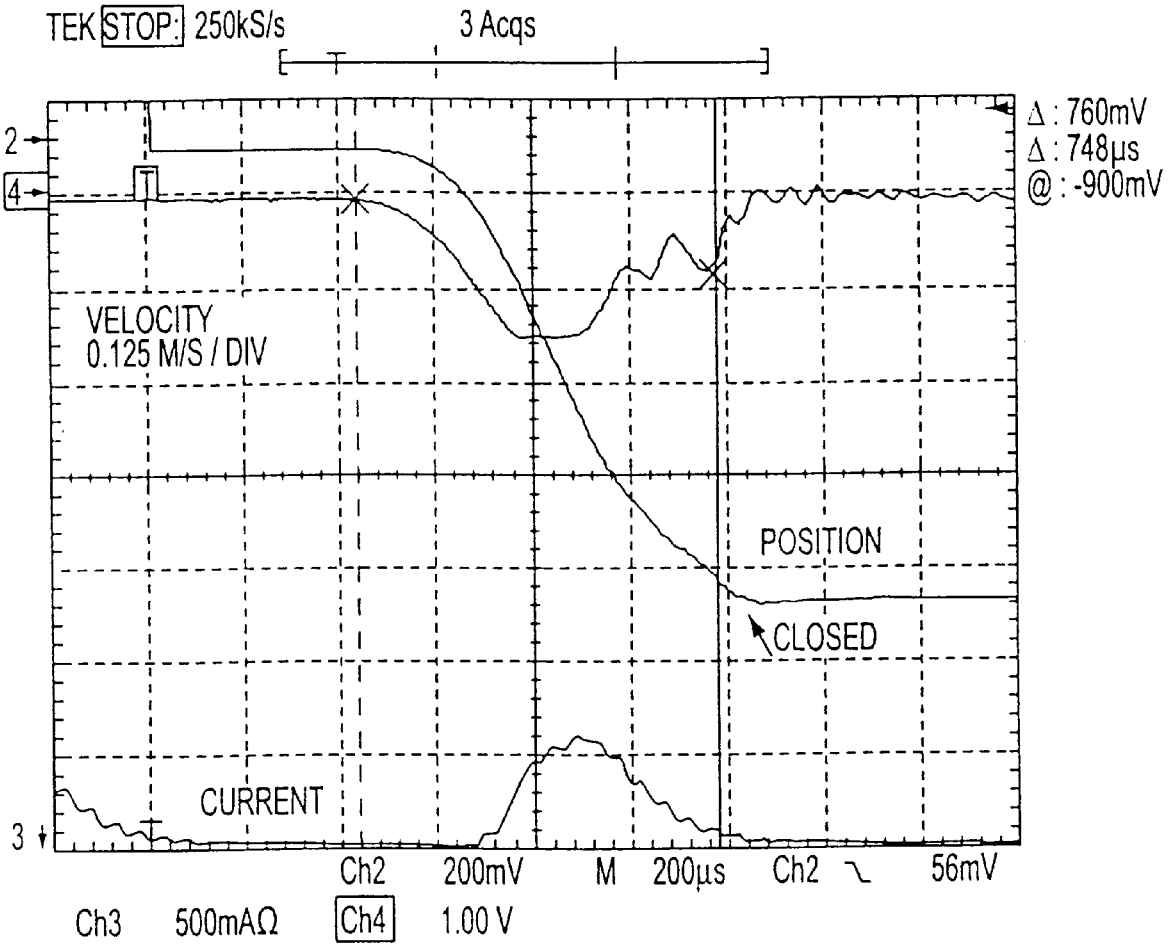
FIG. 9 is a graph of armature position, velocity, and coil current during a closing condition of the fuel injector of FIG. 1.

FIGS. 8 and 9 show current wave shapes for the fuel injector 10 employing impact reduction control using closed loop flux feedback in accordance with the invention. FIG. 8 illustrates that the opening current is allowed to build in the normal manner until motion of the armature 20 just begins. Flux feedback senses this point and then immediately begins closed loop regulation of the rate of build up of flux by reduction of the current in coil 16. Flux feedback subsequently senses the end of the armature motion upon opening at which time flux rate control is terminated and the current of the coil 16 resumes increasing to a predetermined level as in a conventional injector.

Similarly in FIG. 9, it is observed that the current in coil 16 has been reduced to a near zero value to permit the initiation of the closing stroke of the injector 10. A negligible "bias" current is maintained in the coil 16 to permit flux to remain functional and to sense the beginning of armature motion for closing. At this time, flux is caused to increase under closed loop control to provide a force vector which opposes the spring force trying to close the injector 10, thereby again providing impact reduction control. The additional coil current required to accomplish impact reduction control upon closing of the injector 10 appears as the small "bell-shaped" waveform at the bottom of FIG. 9. Once flux feedback has sensed the end of armature motion at closing, the bias current is removed. The above described cycle is repeated under closed loop control for each open/close cycle of the injector 10.

As is evident from FIG. 8 and 9, the invention provides three dramatic improvements over conventional injectors. First, the bounce at impact appears to have been eliminated. Second, the ringing of the velocity has been dampened. Third, the velocity at the point of impact has been substantially reduced to 0.0875 m/s (opening) and 0.0625 m/s (closing). In addition, the audible injector noise was significantly reduced. Accordingly, a more precise metering of fuel can be accomplished by employing the invention.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of controlling velocity of an armature of a electronically operated fuel injector as the armature moves from a first position towards a second position, the fuel injector including a stator core at said second position and a coil associated with said stator core, said coil, said stator core and said armature defining a magnetic circuit, said coil generating a magnetic force to cause the armature to move towards and impact said stator core, the method including:

energizing said coil to permit said armature to move towards said stator core;

determining a rate of change of magnetic flux of said magnetic circuit; and using closed loop feedback control of the determined rate of change of magnetic flux to regulate a rate of magnetic flux by controlling current to said coil so as to control a velocity of said armature upon impact with said stator core.

2. The method according to claim 1, wherein energizing said coil includes permitting current to build until the armature begins to move, feedback of the rate of change of magnetic flux indicating when said armature beings to move, and control of flux is initiated once the armature moves, feedback of the rate of change of magnetic flux determining an end of motion of said armature at which time flux rate control is terminated.

3. The method according to claim 1, wherein the rate of change of magnetic flux is determined by measuring a terminal voltage of said coil.

4. The method according to claim 1, wherein the rate of change of magnetic flux is determined by using a parametrically determined voltage which mirrors a terminal voltage of said coil.

5. The method according to claim 1, wherein the velocity of said armature is controlled so as to be nearly zero as said armature impacts said stator core.

6. A method of controlling movement of an armature of a fuel injector as the armature moves between first and second positions, the fuel injector including a stator core at said second position, a coil associated with said stator core, an injector valve operatively associated with said armature and a spring biasing said injector valve towards a closed position thereof, said injector valve impacting a valve seat when said injector valve is in the closed position thereof and when said armature is generally in the first position thereof, said coil, said stator core and said armature defining a magnetic circuit, said coil generating a magnetic force to cause the armature to move towards and impact said stator core, the method including:

energizing said coil to permit said armature to move towards said stator core;

determining a rate of change of magnetic flux of said magnetic circuit;

using closed loop feedback control of the determined rate of change of magnetic flux to regulate a rate of magnetic flux build-up by controlling current to said coil so as to control a velocity of said armature upon impact with said stator core, reducing a value of current in said coil to a near zero value to initiate a closing stroke of the injector, maintaining a biasing current in said coil to permit feedback of the rate of change of magnetic flux, determining a beginning of armature motion towards said first position thereof by feedback of the rate of change of magnetic flux, and causing magnetic flux to increase under closed loop control to create a force on said armature opposing a force of said spring biasing said injector valve to control a velocity of said injector valve upon impact with said valve seat.

7. The method according to claim 6, wherein said biasing current is terminated when feedback of the rate of change of magnetic flux has determined that armature motion has ended.

8. The method according to claim 6, wherein the rate of change of magnetic flux is determined by measuring a terminal voltage of said coil.

9. The method according to claim 6, wherein the rate of change of magnetic flux is determined by using a parametrically determined voltage which mirrors a terminal voltage of said coil.

10. The method according to claim 6, wherein the velocity of said armature is controlled so as to be nearly zero as said armature impacts said stator core.

11. A fuel injector comprising:

an armature movable between first and second positions;

an injector valve coupled to said armature for movement between closed and open positions as said armature moves between said first and second positions thereof, spring structure biasing said injector valve towards the closed position thereof, a stator core at said second position, a coil associated with said stator core, said coil, when energized, being constructed and arranged to produce a magnetic force on the armature to cause the armature to move towards the second position and impact said stator core, circuit structure providing a certain voltage which corresponds to a level of magnetic flux of a magnetic circuit created by said coil, stator core and said armature, and control structure to control movement of said armature, said control structure being constructed and arranged to determine said certain voltage when said armature is approaching said stator core and to use said certain voltage as a feedback variable to control said level of magnetic flux and thus control a velocity of said armature as said armature impacts said stator core.

12. The fuel injector according to claim 11, wherein said certain voltage corresponds to a rate of change of said magnetic flux.

13. The fuel injector according to claim 11, wherein said control structure is constructed and arranged to measure a terminal voltage of said coil, said terminal voltage defining said certain voltage.

14. The fuel injector according to claim 11, wherein said circuit structure is constructed and arranged to use a parametrically determined voltage which mirrors a terminal voltage of said coil, said control structure determining said parametrically determined voltage, said parametrically determined voltage defining said certain voltage.

15. The fuel injector according to claim 11, wherein said control structure is constructed and arranged to control a velocity of said armature to be near zero upon landing of said armature at said stator core.

16. The fuel injector according to claim 12, wherein said control structure is constructed and arranged to provide a biasing current to said coil to permit feedback of the rate of change of magnetic flux during movement of said injector valve to the closed position thereof so as to control the level of magnetic flux and thus control a velocity of the injector valve as the injector valve moves to the closed position thereof.

* * * * *